United States Patent [19]

Thomason

[11] Patent Number: 5,016,547

[45] Date of Patent: May 21, 1991

[54] REGENERATIVE INCINERATOR

[75] Inventor: Michael C. Thomason, Brighton, Mich.

[73] Assignee: Salem Industries, Inc., South Lyon, Mich.

[21] Appl. No.: 519,414

[22] Filed: May 4, 1990

[51] Int. Cl.[5] ..... F23B 5/00; F23C 9/00; F23G 7/06

[52] U.S. Cl. ..... 110/211; 110/210; 165/4; 165/7; 422/175; 422/182; 431/5

[58] Field of Search ..... 431/5, 202; 422/173, 422/175, 182; 165/4, 7, 8; 110/210, 211

[56] References Cited

U.S. PATENT DOCUMENTS 4,280,416 7/1981 Edgerton ..... 165/4 X
4,454,826 7/1984 Benedick ..... 431/5 X

*Primary Examiner*—Edward G. Favors
*Attorney, Agent, or Firm*—Lyon & Delevie

[57] ABSTRACT

A regenerative incinerator comprises a combustion chamber, a regenerator having a plurality of discrete segments each of which has a heat exchange material therein and a valve for sequentially directing contaminated gas, purge air and cleansed gas to and from discrete segments of said regenerator, selectively.

4 Claims, 2 Drawing Sheets

REGENERATIVE INCINERATOR

BACKGROUND OF THE INVENTION

This invention relates generally to incinerators for the abatement of process emissions, for example, fumes emitted from coating, laminating, painting, or dry cleaning processes, and more specifically, to a novel regenerative incinerator and valve for the control of fluid flow to and from the regenerator portion of the incinerator.

Noxious fumes, waste gases or process emissions, which may be termed "feed gas", "waste gas" or "emissions" generally contain combustible contaminants. However, the amount of combustible material contained in such emissions is generally below several thousand ppm and, accordingly, will not ignite or propagate a flame at ambient temperature.

Incinerators increase the temperature of such emissions to a level above the ignition temperature of the combustible contaminants by the use of heat derived from a supplemental energy source thereby to oxidize the emission.

Regenerative incinerators recover heat remaining in the cleansed exhaust gas to increase the temperature of emissions entering the incinerator thereby minimizing the amount of supplemental energy required to raise the emission to its ignition temperature.

SUMMARY OF THE INVENTION

The present invention relates to an improved regenerative incineration system which includes an improved valve for controlling the system. The system reclaims heat energy in the cleansed discharge gas, which would otherwise be wasted, to supplement heat energy obtained from combustion of a fuel in the incinerator thereby to minimize the amount of fuel necessary to oxidize the emission.

The novel flow control valve of the instant invention directs the emission sequentially to selected segments of a regenerative chamber. The regenerative chamber contains a conventional heat exchange material, for example, ceramic elements. The temperature of the emission is increased from ambient temperature to as close to or above the auto-ignition temperature of the emission as is possible by passing the emission through a previously heated regenerator segment operating in the outlet mode. Thereafter, the emission is completely oxidized in a high-temperature combustion chamber, either by auto-ignition of the contaminants in the emission or by combustion of a supplemental fuel. After oxidation, the cleansed exhaust air leaves the combustion chamber of the incinerator and passes through a second segment of the regenerative chamber that is operating in the outlet mode. The ceramic elements in the outlet mode segment absorb heat from the cleansed gas. The gas is then released to atmosphere or utilized for other heat energy requirements.

Off-line segments of the regenerator between the segments operating in the inlet and outlet mode are purged of contaminants by clean air, which then flows to the combustion chamber. The purge feature assures that segments, after operating in the inlet mode, are purged of contaminants which are then recycled to the combustion chamber of the incinerator as opposed to being discharged to atmosphere.

The alternating inlet/outlet mode of operation of each of the regenerative segments as well as purging of off-line segments of trapped contaminants requires precise timing and control of fluid flow.

DETAILED DESCRIPTION OF THE PREFERRED EMBODIMENT OF THE INVENTION

Figure 1:
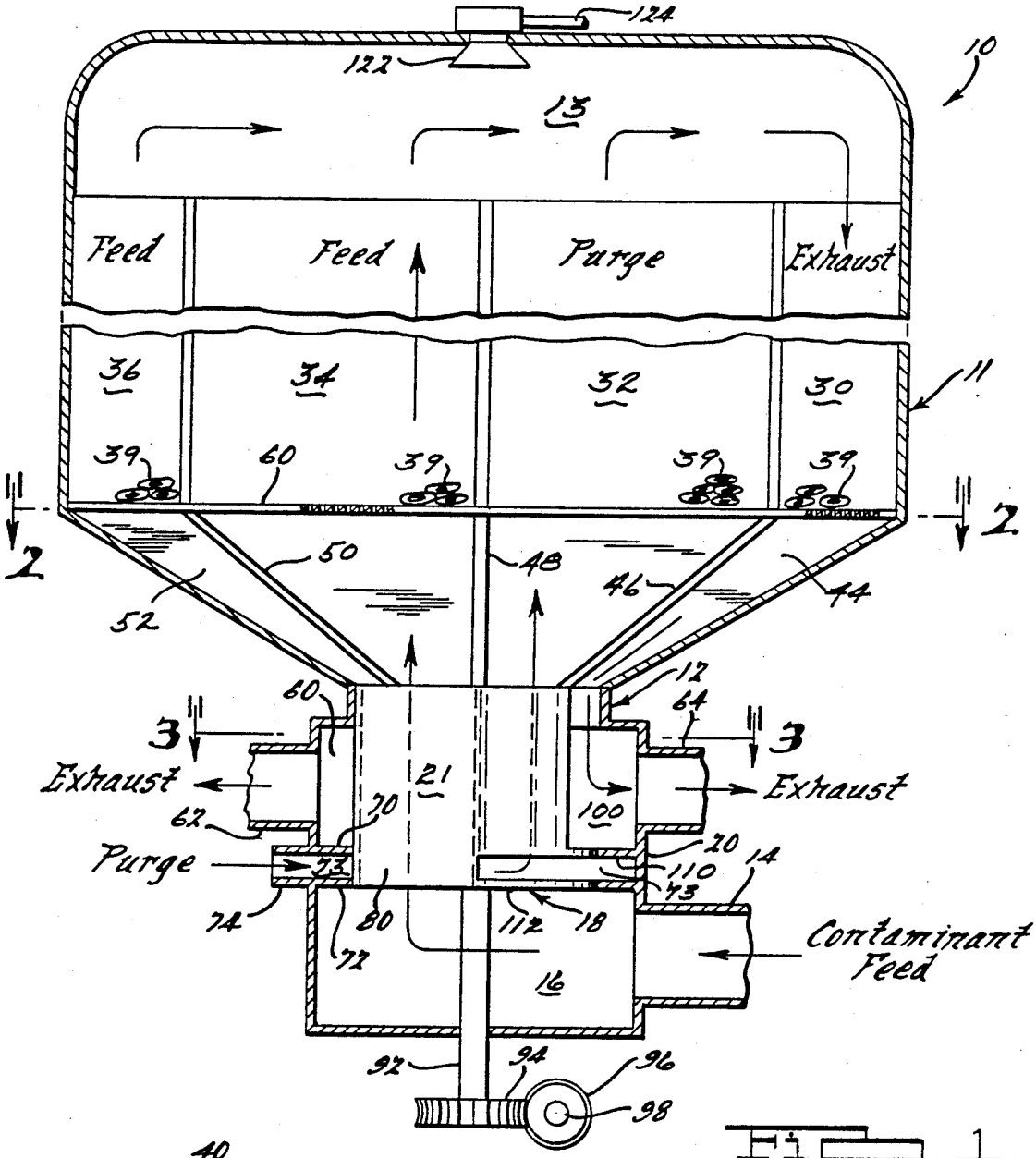
FIG. 1 is a sectional elevational view of a regenerative incinerator for incinerating emissions in accordance with the present invention.
Figure 2:
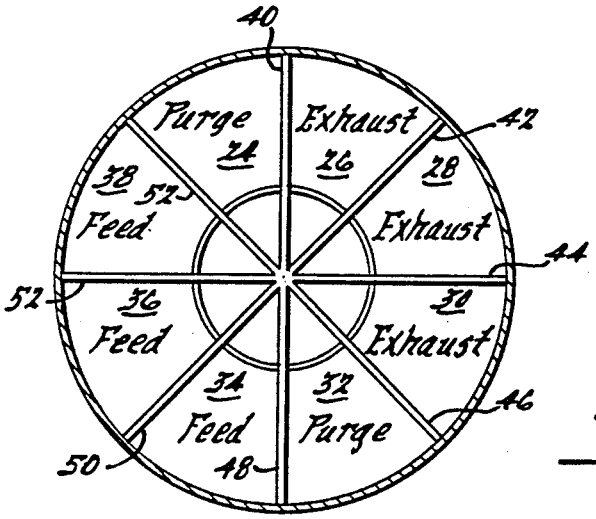
FIG. 2 is a horizontal section taken substantially along line 2—2 of FIG. 1.

As seen in FIG. 1 of the drawings, a regenerative incinerator 10, in accordance with a preferred embodiment of the present invention, comprises a cylindrical regenerator chamber 11 having a flow control valve 12 at the lower end thereof, and a combustion chamber 13 at the upper end thereof. Emissions containing combustible contaminants are admitted to a lower portion of the valve 12 through an inlet duct 14. The inflowing emissions pass through a plenum 16 thence upwardly to a valve core 18 that is journaled for rotation in a valve housing 20. The incoming or feed emissions then flow through a feed passage 21 in the valve core 18 to, as seen in FIG. 2, segments 34–38 of the regenerative chamber 11. The segments 34–38 as well as the other segments 24–32, contain, for example, conventional ceramic heat exchange elements 39.

The segments 24–38 are defined by radially and axially extending partitions 40–52 that are disposed in a circumferentially spaced array. The partitions 40–52 extend downwardly below a perforate horizontal plate 60, which supports the ceramic elements 39 in spaced relation to the valve 12.

Figure 3:
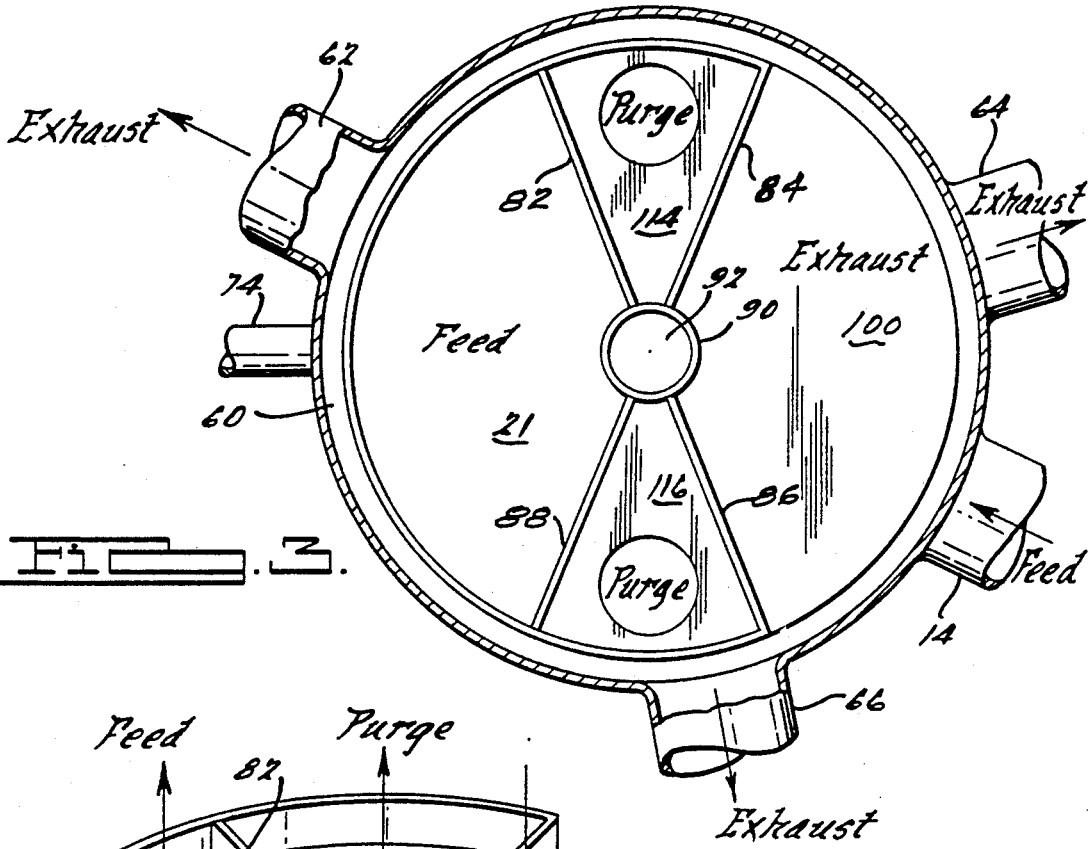
FIG. 3 is a sectional view taken substantially along the line 3—3 of FIG. 1.
Figure 4:
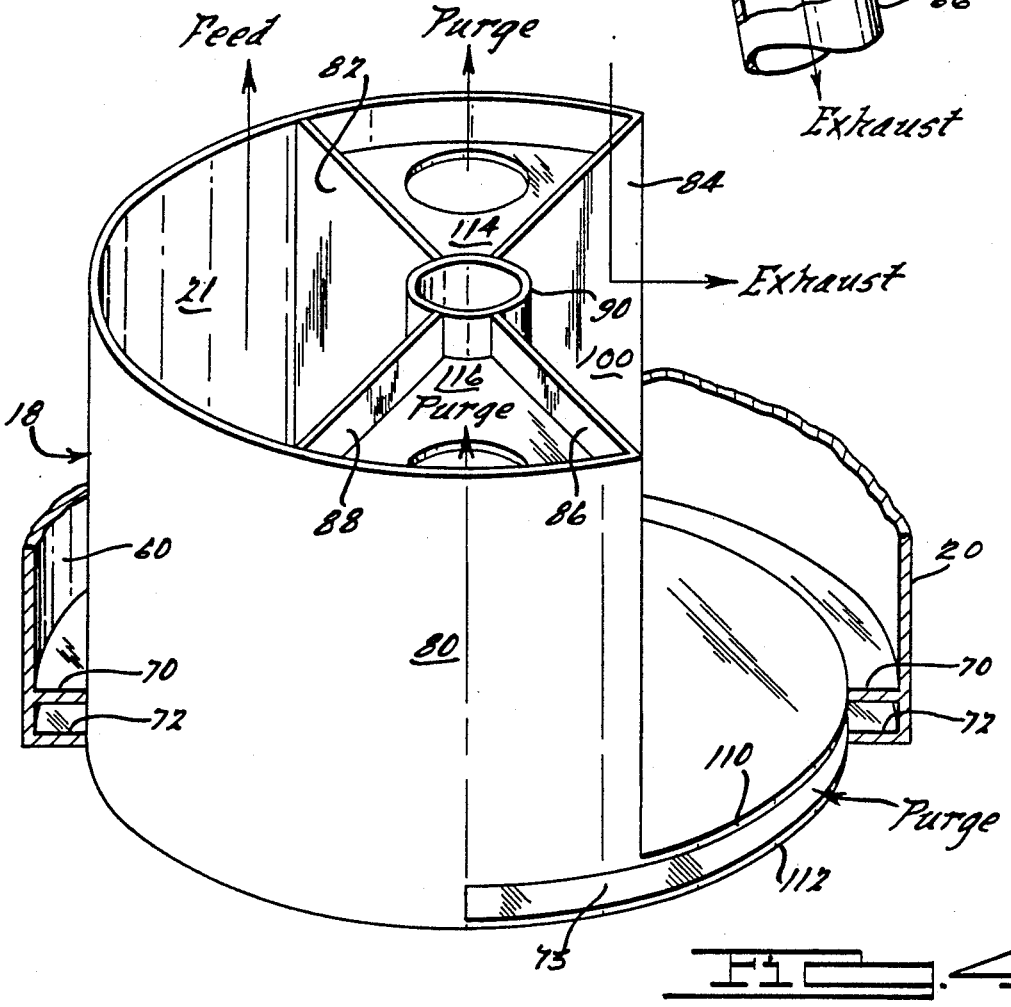
FIG. 4 is a perspective view of the rotary valve of the incinerator.

As best seen in FIGS. 1, 3 and 4, the valve housing 20, in combination with the valve core 18, conducts both incoming emissions and exiting cleansed gas to and from the regenerator and incinerator portions 11 and 13, respectively, of the incinerator 10, as will be described.

The valve housing 20 comprises an annular exhaust manifold 60 for conducting cleansed exhaust gas to a plurality of exhaust gas manifolds 62, 64 and 66.

The valve housing 20 also has a pair of radially inwardly extending annular plates 70 and 72 disposed between the plenum 16 and the exhaust chamber 60 to define a portion of a purge air plenum 73 in fluid flow communication with a radially outwardly extending purge air line 74.

As best seen in FIGS. 3 and 4, the valve core 18 comprises a cylinder 80 that is provided with a plurality of radially and axially extending partitions 82, 84, 86 and 88 in an array complementary to the partitions 40–52 of the regenerator 11. The partitions 82–88 extend radially outwardly from a central sleeve 90 that telescopes over a drive shaft 92 in driving relation. A conventional worm 94 and worm gear 96 effect intermittent rotation of the drive shaft 92 and valve core 18 upon rotation of a drive shaft 98 by a prime mover (not shown), as will be described.

As best seen in FIG. 4, the cylinder 80 of the valve core 18 extends circumferentially to the juncture thereof with the radial partitions 84 and 86 thereby to define a passage 100 for the exhaust of cleansed gas into the exhaust manifold 60. The sleeve 80 is also provided with a pair of segmented axially spaced plates 110 and 112 at the lower extremity thereof that define a radially inner portion of the purge air plenum 73 and conduit air from the line 74 radially inwardly into communicating relationship with vertical passages 114 and 116 defined by the radial plates 82–84 and 88–86. The end plates 110 and 112 are of a diameter complementary to the inside diameter of the annular rings 70 and 72 on the valve housing 20 to minimize leakage of purge air into the feed and exhaust gas streams.

The possibility of transfer of contaminants collected in feed segments 34, 36 and 38 to exhaust air flowing through segments 26, 28 and 30 is minimized by intermittently purging intermediate segments 24 and 32 by clean air. As seen in FIGS. 3 and 4, clean compressed air enters the valve 12 from the purge line 74 thence flows into the purge air plenum defined by the annular plates 70 and 72 of the valve housing 20 and the plates 110 and 112 of the valve core 18. The clean air then flows upwardly through the oppositely radially disposed purge air passages 114 and 116 in the valve core 18 defined by the partitions 82–84 and 86–88 thereof. The purge air is then directed through diametrically opposed regenerative segments, for example, segments 24 and 32 as seen in FIG. 2, thence into the combustion chamber 13 so as to combine with the contaminated emissions undergoing oxidation. The cleansed air then passes downwardly through the exhaust segments 26, 28 and 30 of the regenerator section 11 to the exhaust passage 100 in the valve core 18 thence into the exhaust lines 62, 64 and 66. It is to be noted that purge air is maintained at a relatively higher pressure than the contaminated feed gas thereby to minimize cross over of feed gas to the cleansed exhaust air.

It should be apparent that, since the valve 12 directs purge air into intermediate segments 24 and 32 of the regenerator chamber 11 between the feed and exhaust segments 34–38 and 26–30, respectively, at no time is exhaust air exposed to feed air or to an unpurged regenerator segment.

In operation, contaminant laden emissions enter the incinerator 10 at ambient temperature through the feed line 14 and pass into the lower plenum 16 of the valve 12. The contaminated emissions pass upwardly through the feed chamber 21 in the valve core 18. The emissions then flow upwardly through the segments 34, 36 and 38, as seen in FIG. 2, of the regenerator chamber 11 receiving heat from the ceramic elements supported therein so as to bring the emission temperature to over 700° C. which, in some cases, may be sufficient to sustain oxidation thereof in the combustion chamber 13. If necessary, supplementary heat may be provided by a conventional gas burner 122 fueled by, for example, natural gas conducted thereto through a line 124, thereby bringing the temperature of the emission in the combustion chamber to, for example, over 800° C.

After oxidation of contaminants in the combustion chamber 13, the cleansed air passes downwardly through the segments 26, 28 and 30, as seen in FIG. 2, of the regenerator chamber 11 transferring heat to the ceramic elements therein and raising the temperature thereof to approximately 750° C. Thereafter the cleansed air passes outwardly through the exhaust passage 100 in the valve core 18 to the exhaust lines 62, 64 and 66, thence to atmosphere.

While the temperature of the emissions reaches, for example, 800° C., in the combustion chamber 13, the temperature of the ceramic elements in the outlet segments of the regenerator 11 stabilize at approximately 750° C. adjacent to the combustion zone of chamber 13. When purge air is cycled through the outlet segments, the temperature therein is reduced to, for example, 730° C. Thus, as a practical matter, inlet emissions are raised to approximately 710° C.

Flow time through the segments 24–38 of the regenerator 11 incident to each cycle is preferably about 3 seconds followed by 1 second for indexing of the valve core 18. Indexing of the valve core 18 directs both incoming contaminated emissions and cleansed exhaust air through freshly purged segments of the incinerator section 11.

While the preferred embodiment of the invention has been disclosed, it should be appreciated that the invention is susceptible of modification without departing from the scope of the following claims.

I claim:

1. A regenerative incinerator comprising a combustion chamber;

a regenerator comprising a plurality of discrete segments disposed in a circumferentially spaced circular array about a central axis and in fluid flow communication with said combustion chamber;

a heat exchange material inn each of said segments;

a cylindrical valve housing having a central axis aligned with the central axis of said segments and having inlets for the acceptance of contaminated feed gas and purge gas and an outlet for the discharge of cleansed exhaust gas, and a generally cylindrical valve core disposed internally of said valve housing and mounted for rotation about the central axis thereof, said valve core having a longitudinally extending feed passage connected to said feed inlet, a longitudinally extending exhaust passage diametrically related to said feed passage and connected to said outlet, and a pair of diametrically related longitudinally extending purge gas passages connected to said purge gas inlet, said feed, exhaust and purge gas passages being orientated in a circumferentially spaced circular array complementary to the array of said regenertor segments and in fluid flow communication therewith, one of said purge gas passages being disposed at each circumferentially spaced end of said feed and exhaust gas passages whereby both feed and exhaust gas is immediately exposed to purge gas upon rotation of said valve core to sequentially direct contaminated feed gas, purge gas and cleansed exhaust gas to and from discrete segments of said regenerator.

2. The incinerator of claim 1 wherein said valve core is surrounded by an exhaust air chamber.

3. The incinerator of claim 1 wherein said valve comprises a feed gas plenum underlying the valve core thereof.

4. The incinerator of claim 3 wherein a purge air plenum is disposed between said feed gas plenum and said valve core.

* * * * *